US009714659B2

(12) United States Patent
Inada et al.

(10) Patent No.: US 9,714,659 B2
(45) Date of Patent: Jul. 25, 2017

(54) AXIAL FLOW FAN

(71) Applicant: SANYO DENKI CO., LTD., Tokyo (JP)

(72) Inventors: Naoya Inada, Tokyo (JP); Jiro Watanabe, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 1005 days.

(21) Appl. No.: 13/852,868

(22) Filed: Mar. 28, 2013

(65) Prior Publication Data

US 2014/0003933 A1 Jan. 2, 2014

(30) Foreign Application Priority Data

Mar. 30, 2012 (JP) ..... 2012-081465

(51) Int. Cl.
*F04D 19/00* (2006.01)
*F04D 29/38* (2006.01)
*F04D 29/68* (2006.01)

(52) U.S. Cl.
CPC ..... *F04D 19/002* (2013.01); *F04D 29/384* (2013.01); *F04D 29/681* (2013.01); *F05D 2240/305* (2013.01)

(58) Field of Classification Search
CPC .... F04D 19/002; F04D 29/384; F04D 29/681; F04D 25/0606; F05D 2240/305; Y10S 416/02; Y10S 416/05
USPC ..... 415/220, 221, 223, 224
See application file for complete search history.

(56) References Cited

U.S. PATENT DOCUMENTS 4,971,520 A * 11/1990 Van Houten ..... F04D 29/386 416/169 A
5,184,938 A * 2/1993 Harmsen ..... F04D 25/0606 415/119
D663,689 S * 7/2012 Lee ..... D13/115
D668,606 S * 10/2012 Lee ..... D13/115
2003/0012656 A1 1/2003 Cho
2007/0286726 A1 12/2007 Yabuuchi

FOREIGN PATENT DOCUMENTS

CN 2554409 Y 6/2003
CN 101086264 A 12/2007
JP S55-028710 U 2/1980
(Continued)

OTHER PUBLICATIONS

Extended European Search Report issued on Apr. 13, 2016 for the corresponding European Patent Application No. 13160940.6.
(Continued)

*Primary Examiner* — Nicholas J Weiss
*Assistant Examiner* — Dapinder Singh
(74) *Attorney, Agent, or Firm* — Polsinelli PC

(57) ABSTRACT

An axial flow fan includes: an impeller, a hub of which is attached to a rotation shaft of a rotation driving device; and a venturi casing that surrounds an outer circumference in a radial direction of the impeller and includes a suction port and a discharge port facing each other in an axial direction of the rotation shaft. A positive pressure surface of a plurality of blades integrally attached to the hub includes a plurality of step portions that is curved so as to comply with a curved shape of a front edge portion in a rotation direction of the blades.

10 Claims, 4 Drawing Sheets

(56) References Cited

FOREIGN PATENT DOCUMENTS

| | | | |
|---|---|---|---|
| JP | 5332294 | A | 12/1993 |
| JP | H06-87692 | U | 12/1994 |
| JP | H07119695 | A | 5/1995 |
| JP | H07-293495 | A | 11/1995 |
| JP | H08-074790 | A | 3/1996 |
| JP | 11037092 | A | 2/1999 |
| JP | 2003-193997 | A | 7/2003 |
| JP | 2004-317065 | A | 11/2004 |
| JP | 2012-047080 | A | 3/2012 |
| KR | 20020094183 | A | 12/2002 |

OTHER PUBLICATIONS

Japanese Office Action mailed on Dec. 1, 2015 for the corresponding Japanese Patent Application No. 2012-081465.
Chinese Office Action issued on Feb. 3, 2016 for the corresponding Chinese Patent Application No. 201310098880.6.
Office Action dated Apr. 6, 2017 issued in corresponding Taiwanese Application No. 102108344.
Office Action dated May 12, 2017 issued in corresponding Chinese Patent Application No. 201310098880.6.

* cited by examiner

FIG. 5 ( A )
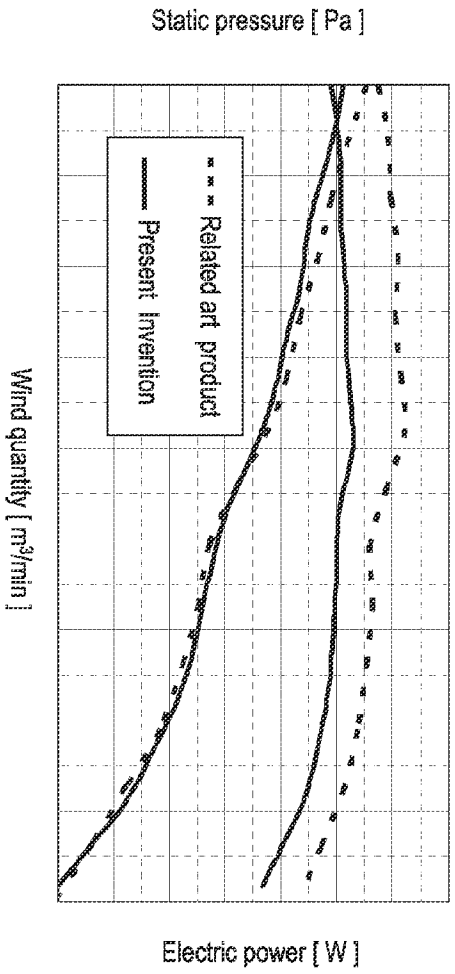
FIG. 5 ( B )
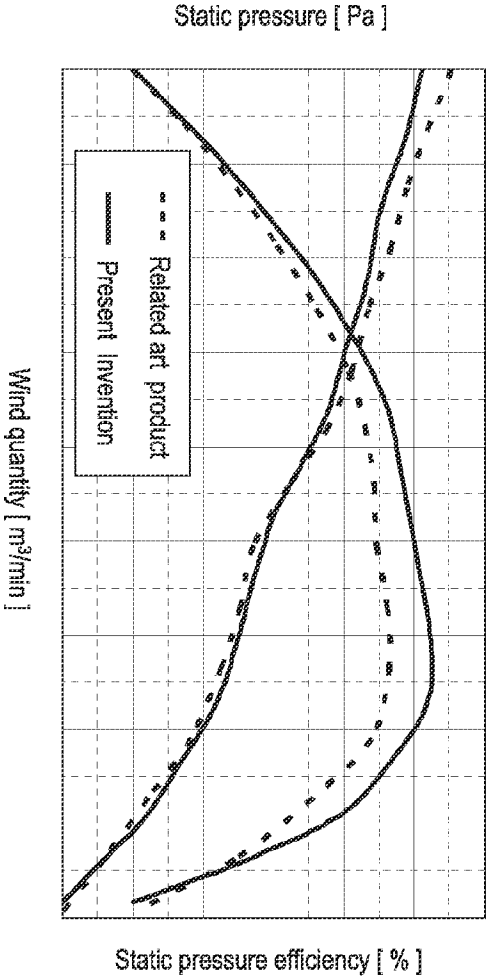

AXIAL FLOW FAN

CROSS-REFERENCE TO RELATED APPLICATION

This application claims priority to Japanese Application No. 2012-081465, filed Mar. 30, 2012, the entirety of which is incorporated herein by reference.

BACKGROUND

1. Technical Field

The present invention relates to an axial flow fan in which a shape of a positive pressure surface of a blade of an impeller is improved.

2. Description of Related Arts

The axial flow fan includes a plurality of blades in a radial shape on an outer circumference of a hub serving as a rotation center. Since the axial flow fan has a simple structure, the axial flow fan is widely used in a personal computer (PC), a cooling fan for a server, a ventilation fan or the like.

Generally, the axial flow fan has blowing characteristics in which a wind quantity is high and a static pressure is low. In order to improve the blowing characteristics of the axial flow fan to reduce noise, various schemes have been performed on the structure of the blades.

As a technique related to the blade structure of the axial flow fan, an axial flow fan is disclosed in which a plurality of blades is included on an outer circumference of a hub serving as a rotation center, a plurality of dimples is formed on a negative pressure surface of each blade, and a relationship of $0.15 \leq d/\phi \leq 0.3$ is set when assuming a depth of the dimple to d and a hole diameter of the dimple to $\phi$ (for example, see JP 5-332294 A).

The technique of JP 5-332294 A suppresses a development of a boundary layer and a separation of a flow on the negative pressure surface of the blade, and plans the reduction of the noise of the axial flow fan and the improvement in aerodynamic performance, by forming the plurality of dimples on the negative pressure surface of each blade on a predetermined condition.

Furthermore, an axial flow fan is disclosed which is formed by providing a plurality of protrusions on a pressing surface of the blade, and by forming a streamlined blade shape by a surface formed by joining tops of the protrusions and the negative pressure surface of the blade (for example, JP 11-37092 A).

The technique of JP 11-37092 A provides an axial flow fan that has a high blowing efficiency and a low noise, and is lightweight, by providing a plurality of protrusions on the pressing surface (a positive pressure surface) so as to form the streamlined blade shape by the negative pressure surface of the blade.

However, according to the techniques of JP 5-332294 A and JP 11-37092 A, the reduction of the electric power consumption of the axial flow fan is not examined at all, and even when the blowing efficiency is improved and the noise is reduced, the technical value is reduced by half when the electric power consumption increases.

Recently, along with the maintenance promotion of the internet and the infrastructure, a large server has spread. A plurality of about forty cooling fans is attached to the casing of the large server. A power source of the plurality of cooling fans is normally supplied from a single power source device stored in the casing, and thus load to the power source device is great. Thus, when the electric power consumption of each of the cooling fans can be lowered even a little, it is possible to greatly lower the load to the power source device as a whole of the cooling fans.

The present invention was made in view of the above-mentioned circumstances, and an object thereof is to provide an axial flow fan capable of improving the blowing efficiency and the static pressure efficiency and reducing the electric power consumption.

SUMMARY

In order to achieve the above-mentioned object, there is provided an axial flow fan that includes an impeller, a hub of which is attached to a rotation shaft of a rotation driving device; and a venturi casing that surrounds an outer circumference in a radial direction of the impeller and includes a suction port and a discharge port facing each other in an axial direction of the rotation shaft.

Positive pressure surfaces of a plurality of blades integrally attached to the hub have a plurality of step portions that is curved so as to comply with a curved shape of a front edge portion in the rotation direction of the blade.

The axial flow fan according to the present invention is configured so that the positive pressure surfaces of each blade have the plurality of step portions. Each of the step portions is curved so as to comply with the curved shape of the front edge portion in the rotation direction of the blade.

Accordingly, it is considered that a discharge flow between the positive pressure surface of each blade and the venturi casing forms a vortex flow in a rear hollow in the rotation direction of each of the curved step portions. According to the present invention, since the rear discharge flow passes on the phased vortex flow formed by the plurality of step portions, the blowing efficiency and the static pressure efficiency of the axial flow fan can be improved, and the electric power consumption can be reduced.

BRIEF DESCRIPTION OF THE DRAWINGS

FIGS. 5A and 5B are diagrams that describe blowing characteristics of an experimental model of the axial flow fan of the present embodiment.

DETAILED DESCRIPTION

Figure 1:
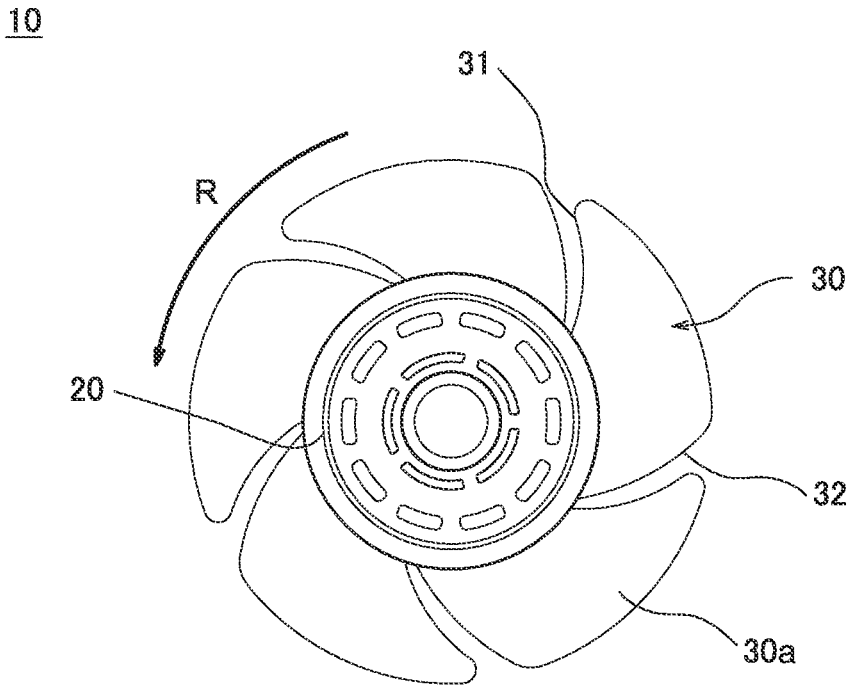
FIG. 1 is a front view of an axial flow fan of the present embodiment.

Hereinafter, an axial flow fan of the present embodiment will be described referring to the drawings.

The axial flow fan of the present embodiment includes a plurality of step portions that is curved so as to comply with a curved shape of a front edge portion in a rotation direction of the blade, on positive pressure surfaces of the plurality of blades integrally attached to a hub. According to the present embodiment, a rear discharge flow passes on a phased vortex flow formed by the plurality of step portions. Thus, an axial flow fan is realized which is able to improve the blowing efficiency and the static pressure efficiency, and reduce the electric power consumption.

Configuration of Axial Flow Fan

Figure 2:
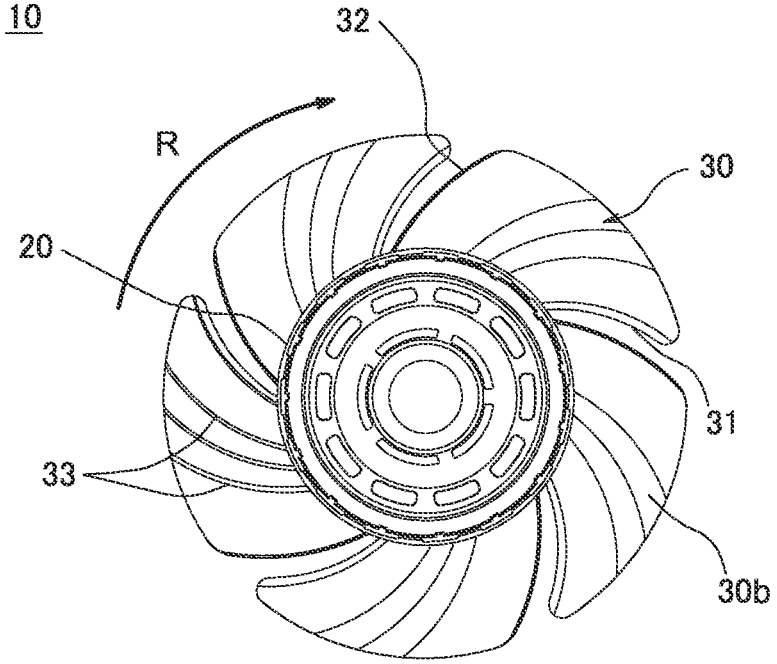
FIG. 2 is a rear view of the axial flow fan of the present embodiment.
Figure 3:
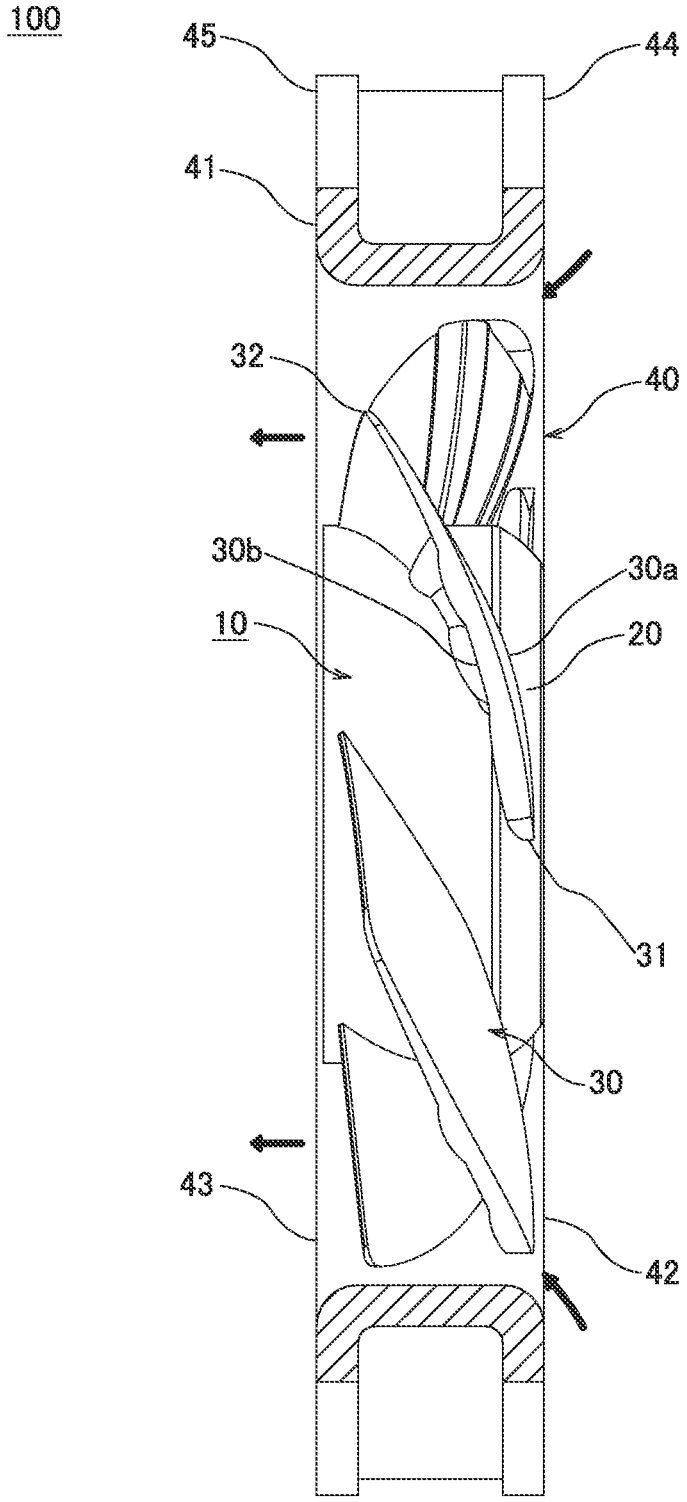
FIG. 3 is a schematic side view that illustrates a state where a part of the axial flow fan of the present embodiment is cut.
Figure 4:
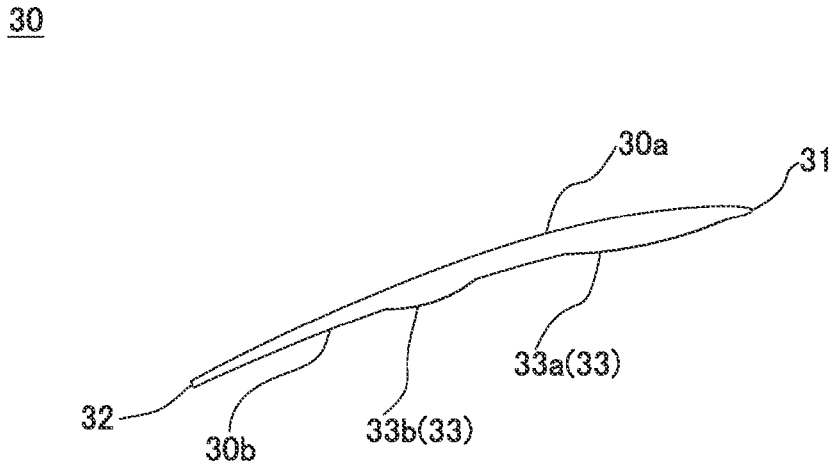
FIGS. 4A to 4C are a top view, a bottom view and a rear view of a blade in the axial flow fan of the present embodiment.
Figure 4:
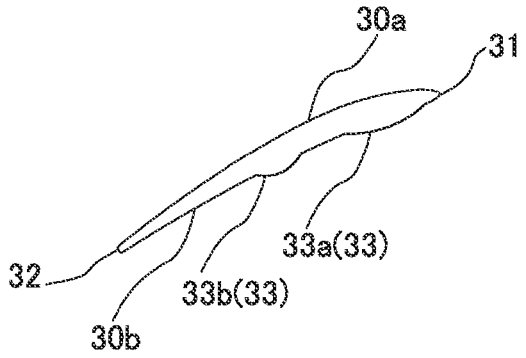
Figure 4:
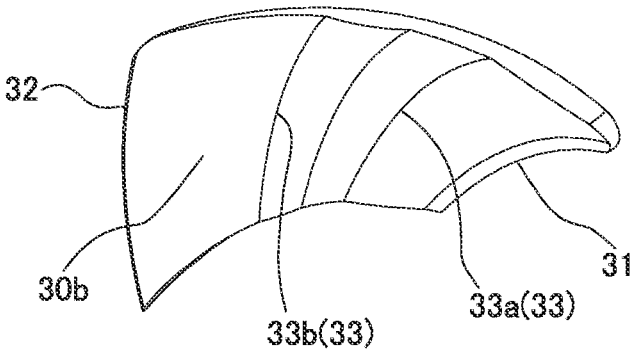

First, a configuration of the axial flow fan of the present embodiment will be described referring to FIGS. 1 to 3. FIG. 1 is a front view of the axial flow fan of the present embodiment. FIG. 2 is a rear view of the axial flow fan of the present embodiment. FIG. 3 is a schematic side view that illustrates a state where a part of the axial flow fan of the present embodiment is cut. FIGS. 4A to 4C are a top view, a bottom view and a rear view of a blade in the axial flow fan of the present embodiment.

As illustrated in FIG. 3, an axial flow fan 100 of the present embodiment includes an impeller 10 attached to a rotation shaft of a rotation driving device (not illustrated), and a venturi casing 41 that surrounds an outer circumference in a radial direction of the impeller 10.

The venturi casing 41 is a member that constitutes a major part of a fan frame 40. The venturi casing 41 is a member of a cylindrical body shape that partitions and forms a wind tunnel as a passage of the wind caused by the impeller 10. Openings of both ends in an axial direction of the venturi casing 41 each serve as a suction port 42 and a discharge port 43.

On peripheries of a suction side and a discharge side of the venturi casing 41, flange portions 44 and 45 for fixing the fan frame 40 to an electronic device or the like are provided. The flange portions 44 and 45 are square-shaped attachment members that continue with an outer circumferential wall of the venturi casing 41. In four corners of each of the flange portions 44 and 45, screw holes (not illustrated) for screwing with attaching screws are formed.

In addition, although the fan frame 40 including the venturi casing 41 and the flange portions 44 and 45 are formed by aluminum or aluminum alloy, other metallic materials, a thermoplastic synthetic resin or the like may be used, without being limited to the described material.

The impeller 10 includes a hub 20 serving as a rotation center, and a plurality of blades 30 integrally attached to the outer circumference of the hub 20.

The hub 20 is a cup-like member provided in the central portion of the impeller 10. A rotor yoke of a motor (not illustrated) as a rotation driving device of the impeller 10 is fitted into the hub 20. A base portion of the motor is supported by the fan frame 40.

As illustrated in FIG. 1, the plurality of blades 30 is integrally and radially attached around the hub 20 serving as the rotation center. Although the impeller 10 in the present embodiment includes five blades 30, the number of the blades 30 is not limited to five. Although the hub 20 and the blade 30 are formed by the thermoplastic synthetic resin, the materials thereof are not limited to the described materials. As the thermoplastic synthetic resin, there are resins including polyethylene (PE), polypropylene (PP), polystyrene (PS), polyvinyl chloride (PVC), polycarbonate (PC), polymethylmethacrylate (PMMA), acrylonitrile-butadiene-styrene (ABS), PC/ABS, polyamide (PA), and polyoxymethylene (POM).

Each blade 30 has an airfoil shape. Each blade 30 is integrally attached to the hub 20 so that a leading end side (a protruding side) of each blade 30 of the airfoil shape is located on the front side in the rotation direction R of the impeller 10.

A base end portion (an inner circumferential end portion) of each blade 30 is attached to the hub 20 so as to be inclined with respect to an axial direction of the rotation shaft. Specifically, each blade 30 is attached to the hub 20 in an inclined manner so that a front edge portion 31 in the rotation direction of the blade 30 is located on a head portion side of the hub 20 and a rear edge portion 32 thereof is located on an opening side of the hub 20 (see FIG. 3).

As illustrated in FIGS. 1 to 3, the impeller 10 is placed in the venturi casing 41 so that a front side of each blade 30 serves as a suction port 42 side and a rear side thereof serves as a discharge port 43 side. Thus, in the axial flow fan 100, the front side of each blade 30 serves as a negative pressure surface 30*a*, and the rear side thereof serves as a positive pressure surface 30*b*.

The axial flow fan 100 of the present embodiment is configured so that the positive pressure surface 30*b* of each blade 30 is formed with a plurality of curved step portions 33. The plurality of curved step portions 33 is formed only on the positive pressure surface 30*b* of each blade 30, and the negative pressure surface 30*a* is formed by the normal smooth surface.

FIG. 4A is a top view of the outer circumference surface of the blade, FIG. 4B is a bottom view of an inner circumferential surface (a proximal end surface) of the blade, and FIG. 4C is a rear view of the blade.

As illustrated in FIGS. 2 to 4C, each step portion 33 is formed so as to comply with the curved shape of the front edge portion 31 of the blade 30. Each step portion 33 is extended and curved from the base end portion (the inner circumferential portion) of each blade 30 up to the outer circumferential portion, in the positive pressure surface 30*b* of each blade 30. A curvature of the plurality of step portions 33 is formed to be smaller than a curvature of the front edge portion 31 of the blade 30 and to be greater than the curvature of the rear edge portion 32. In the present embodiment, two step portions 33*a* and 33*b* are provide on the positive pressure surface 30*b* of each blade 30. The curvature of the step portion 33*b* located on the rear edge portion 32 side of the blade 30 is set to be smaller than the curvature of the step portion 33*a* located on the front edge portion 31 side.

In the present embodiment, although two step portions 33*a* and 33*b* are provided on the positive pressure surface 30*b* of each blade 30, the number of the step portions is not limited to two.

As illustrated in FIGS. 4A and 4B, on a cross section of each blade 30, the thickness of the positive pressure surface 30*b* gradually increases from the front edge portion 31, and rapidly decreases compared to the degree of the increase via the step portion 33*a*. In addition, the thickness rapidly decreased via the step portion 33*a* gradually increases again, rapidly decreases compared to the degree of the increase via the step portion 33*b*, and then reaches the rear edge portion 32. That is, the cross-sectional shape of the positive pressure surface 30*b* of the blade 30 progressively repeats a shape in which the thickness smoothly increases from the front edge portion 31 side of the blade 30 and the thickness rapidly decreases via the step portion 33.

Meanwhile, as mentioned above, the negative pressure surface 30*a* of each blade 30 is formed by the normal smooth surface. When observing the cross-sectional shape of the positive pressure surface 30*b* and the cross-sectional shape of the negative pressure surface 30*a* of the blade 30 entirely and together, the cross-sectional shape of each blade 30 has a shape as if two streamlines are arranged in series from the front edge portion 31 side toward the rear edge portion 32 side.

In addition, when the number of the step portions 33 is equal to or greater than three, the cross-sectional shape of each blade 30 has a shape as if the streamlines depending on the number of the step portions 33 are arranged in series.

Operation of Axial Flow Fan

Next, the operation of the axial flow fan 100 of the present embodiment will be described referring to FIGS. 1 to 5B.

As illustrated in FIG. 3, the axial flow fan 100 is attached to a case or the like of an electronic device by screwing with an attachment screw (not illustrated) to a suction side flange portion 44 or a discharge side flange portion 45. For example, when using the axial flow fan 100 of the present embodiment as a cooling fan for a PC and a server, the suction side flange portion 44 is attached to the fan attachment portion of the inner surface of the case of the PC or the like. Furthermore, when using the axial flow fan 100 of the present embodiment as a ventilation fan, the discharge side flange portion 45 is attached to a peripheral portion of the opening portion of an inner wall of a building.

When using the axial flow fan 100 of the present embodiment as a cooling fan for a server, in the venturi casing 41, the negative pressure surface 30*a* of each blade 30 of the impeller 10 faces the outside of the case of the server, and the positive pressure surface 30*b* thereof faces the inside of the case. During operation of the server, the impeller 10 of the axial flow fan 100 rotates, and the outside air is taken into the case to air-cool an electronic device such as a hard disk (HDD).

The outside air sucked from the suction port 42 of the axial flow fan 100 is discharged into the case through the discharge port 43 from between the blade 30 of the impeller 10 and the venturi casing 41.

The axial flow fan 100 of the present embodiment is formed with a plurality of curved step portions 33 on the positive pressure surface 30*b* of each blade 30. Each step portion 33 is curved so as to comply with the curved shape of the front edge portion 31 in the rotation direction of each blade 30. Each step portion 33 is extended and curved up from the base end portion (the inner circumferential portion) of each blade 30 to the outer circumferential portion thereof, in the positive pressure surface 30*b* of each blade 30. The step portion 33*b* located on the rear edge portion 32 side of the blade 30 is curved so that the curvature thereof is reduced compared to the step portion 33*a* located on the front edge portion 31 side.

The cross-sectional shape of the positive pressure surface 30*b* of the blade 30 progressively repeats a shape in which the thickness thereof smoothly increases from the front edge portion 31 side of the blade 30 and the thickness thereof rapidly decreases via the step portion 33. Thus, the cross-sectional shape of the blade 30 has a shape as if the streamlined blades are arranged in series from the front edge portion 31 side toward the rear edge portion 32 side.

As illustrated in FIGS. 5A and 5B, the blowing characteristics of the axial flow fan 100 of the present embodiment having the above-mentioned blade structure were confirmed by a comparison with the structure of the related art, by manufacturing and driving an experimental model of the axial flow fan 100 of the present embodiment. The axial flow fan of the structure of the related art includes the same five blades as the present embodiment, and includes an impeller in which the negative pressure surface and the positive pressure surface of each blade are formed by the smooth surface.

FIG. 5 is a diagram that describes the blowing characteristics of the experimental model of the axial flow fan of the present embodiment. In addition, the blowing characteristics were measured about a rotary speed, a maximum wind quantity, a maximum static pressure, a sound pressure level, electric power consumption, static pressure efficiency, and blade efficiency.

First, FIG. 5A is a diagram that describes a relationship between the wind quantity and the electric power consumption of the axial flow fan of the present embodiment by the comparison with the structure of the related art. In FIG. 5A, relative curved lines between the wind quantity and the static pressure of the axial flow fan of the present embodiment and the axial flow fan having the structure of the related art are combined with each other.

As illustrated in FIG. 5A, as the wind quantity of the axial flow fan increases, the static pressure gradually decreases. Furthermore, when increasing the wind quantity of the axial flow fan, the electric power consumption gently rises and then decreases while drawing a descent curve.

When combining the relative curved lines between the wind quantity and the static pressure of the axial flow fan of the present embodiment and the axial flow fan having the structure of the related art, in the axial flow fan of the present embodiment, the reduction of the minimum electric power consumption [W] of about 12.7% was obtained compared to the axial flow fan having the structure of the related art.

Next, FIG. 5B is a diagram for describing the relationship between the wind quantity and the static pressure efficiency of the axial flow fan of the present embodiment by the comparison with the structure of the related art. In FIG. 5B, relative curved lines between the wind quantity and the static pressure of the axial flow fan of the present embodiment and the axial flow fan having the structure of the related art are combined with each other.

As illustrated in FIG. 5B, as the wind quantity of the axial flow fan increases, the static pressure gradually decreases. Furthermore, when increasing the wind quantity of the axial flow fan, the static pressure efficiency changes while drawing a mountain-like curve.

When combining the relative curved lines between the wind quantity and the static pressure of the axial flow fan of the present embodiment and the axial flow fan having the structure of the related art, in the axial flow fan of the present embodiment, the improvement in the maximum static pressure efficiency of about 5.8% was obtained compared to the axial flow fan having the structure of the related art. Furthermore, in the axial flow fan of the present embodiment, the improvement in the maximum blade efficiency of about 7.5% was obtained compared to the axial flow fan having the structure of the related art.

From the measurement result of the blowing characteristics of the experimental model of FIGS. 5A and 5B, it is considered that the discharge flow between the positive pressure surface 30*b* of each blade 30 and the venturi casing 41 forms a vortex flow in the rear hollow in the rotation direction of the respective curved step portions 33*a* and 33*b*. That is, according to the axial flow fan 100 of the present embodiment, the rear discharge flow passes on the phased vortex flow formed by the plurality of step portions 33*a* and 33*b*. Thus, the blowing efficiency and the static pressure efficiency can be improved, and the electric power consumption can be reduced.

Particularly, in the case of the large server, since there are many numbers of the incorporated HDD, about forty cooling fans (the axial flow fans) 100 are attached. Since the power source of a lot of cooling fans are normally supplied from a single power source device stored in the case, the load to the power source device is great.

The axial flow fan 100 of the present embodiment has the advantageous effect that can reduce the electric power consumption of the respective cooling fans, and can greatly reduce the load to the electric power device as a whole of the cooling fans.

Although the preferred embodiments of the present invention have been described above, the embodiments are examples for describing the present invention, and the scope of the present invention is not intended to be limited only to the embodiments. The present invention can be carried out in various aspects that are different from the above-mentioned embodiments, within the scope that does not depart from the gist thereof.

Furthermore, although the positive pressure surface of the blade of the axial flow fan is formed with the curved step portion in the above-mentioned embodiments, the present invention can also be applied to a positive pressure surface of a blade of another type fan including a sirocco fan.

What is claimed is:

1. An axial flow fan comprising:

an impeller, a hub of which is attached to a rotation shaft of a rotation driving device; and a plurality of blades integrally attached to the hub, a plurality of step portions on a positive pressure surface of each of the plurality of blades, each of the plurality of step portions being curved so as to comply with a curved shape of a front edge portion in a rotation direction of the blades;

one of the plurality of step portions on each of the blades is centrally located between a front edge and a rear edge of the blade and extends in an arcuate pathway from a root of the blade to a tip of the blade.

2. The axial flow fan according to claim 1, wherein the respective step portions are extended and curved from an inner circumferential portion of each blade to an outer circumferential portion thereof, in the positive pressure surface of each blade.

3. The axial flow fan according to claim 1, wherein the step portion located on a rear edge portion side of the blade is curved so that a radius of curvature thereof is smaller than the radius of curvature of the step portion located on a front edge portion side.

4. The axial flow fan according to claim 1, wherein the cross-sectional shape of the blades includes a shape in which streamlined blades are arranged in series from the front edge portion side toward the rear edge portion side.

5. The axial flow fan according to claim 1, wherein one of the plurality of step portions on each of the blades is centrally located between the front edge and the rear edge of the blade and extends in an arcuate pathway from a root of the blade to a tip of the blade.

6. The axial flow fan according to claim 1, wherein the one of the plurality of step portions begins at the root of the blade and extends to a tip of the blade.

7. An axial flow fan comprising:

an impeller, a hub of which is attached to a rotation shaft of a rotation driving device; and a venturi casing that surrounds an outer circumference in a radial direction of the impeller, and includes a suction port and a discharge port facing each other in an axial direction of the rotation shaft, wherein a positive pressure surface of the plurality of blades integrally attached to the hub includes a plurality of step portions that is curved so as to comply with a curved shape of a front edge portion in a rotation direction of the blades;

wherein one of the plurality of step portions on each of the blades is centrally located between the front edge and a rear edge of the blade and extends in an arcuate pathway from a root of the blade to a tip of the blade.

8. The axial flow fan according to claim 7, wherein the one of the plurality of step portions begins at the root of the blade and extends to a tip of the blade.

9. An axial flow fan, comprising:

an impeller, a hub of which is attached to a rotation shaft of a rotation driving device; and a plurality of blades integrally attached to the hub, wherein a positive pressure surface of the plurality of blades includes a plurality of step portions that is curved so as to comply with a curved shape of a front edge portion in a rotation direction of the blades;

wherein a cross-sectional shape of the positive pressure surface of the blade progressively repeats a shape in which a thickness smoothly increases from the front edge portion side of the blade and rapidly decreases at an edge of the step portion;

wherein one of the plurality of step portions on each of the blades is centrally located between the front edge and a rear edge of the blade and extends in an arcuate pathway from a root of the blade to a tip of the blade.

10. The axial flow fan according to claim 9, wherein the one of the plurality of step portions begins at the root of the blade and extends to a tip of the blade.

* * * * *